United States Patent [19]

Lyons

[11] 4,187,994

[45] Feb. 12, 1980

[54] YARN WINDING APPARATUS

[75] Inventor: Thomas B. Lyons, Wilmington, Del.

[73] Assignee: E. I. Du Pont de Nemours and Company, Wilmington, Del.

[21] Appl. No.: 21,569

[22] Filed: Mar. 16, 1979

[51] Int. Cl.[2] ..... B65H 54/20; B65H 54/42

[52] U.S. Cl. ..... 242/35.5 R; 242/18 DD; 242/18 PW

[58] Field of Search ..... 242/18 R, 18 PW, 18 DD, 242/35.5 R, 42, 43 R

[56] References Cited

U.S. PATENT DOCUMENTS

| | | | |
|---|---|---|---|
| 2,647,697 | 8/1953 | Pollock, Jr. | 242/35.5 R |
| 2,919,865 | 1/1960 | Doherty | 242/35.5 R |
| 3,086,722 | 4/1963 | Altice et al. | 242/43 R |
| 3,103,305 | 9/1963 | Heatherly | 242/18 PW X |
| 3,276,704 | 10/1966 | Pabis | 242/18 PW |
| 3,276,719 | 10/1966 | Stetz | 242/157 R |
| 3,628,741 | 12/1971 | Enneking | 242/18 DD |
| 3,642,217 | 2/1972 | Sistare et al. | 242/35.5 R |
| 3,724,769 | 4/1973 | Brooks | 242/18 DD |
| 3,845,911 | 11/1974 | Wyatt | 242/18 DD |
| 4,033,519 | 7/1977 | Abe et al. | 242/18 PW |

FOREIGN PATENT DOCUMENTS

| | | | |
|---|---|---|---|
| 2146200 | 3/1973 | France | 242/35.5 R |

*Primary Examiner*—Stanley N. Gilreath

[57] ABSTRACT

In a yarn windup a reciprocating traverse guide is provided with two slots for handling two individual yarns. The shape of the guide and the location of the slots in combination with an elongated guide member located adjacent the traverse guide facilitate string up of individual yarn lines into their respective slots.

3 Claims, 7 Drawing Figures

YARN WINDING APPARATUS

BACKGROUND

This invention relates to the packaging of yarns and more particularly to reciprocating traverse guides for use therein.

In prior art winding apparatus that winds two ends of yarn both ends of yarn advance through a single slot in a traverse guide to a rotating package. The guide functions to sweep or to traverse the yarn from end to end of a parallel pair of yarn packages and the traverse mechanism may guide the yarn directly to each of the packages or may guide the yarn to a drive roll or print roll and thence to the packages. In either case, when the threadlines occupy a common guide slot, it is found that the threadline interaction causes a package defect known as overthrown ends, in which a short length of yarn in a reversal "falls" off the end of the package and lies along a chord across the end of the package. This defect occurs at a lower helix angle than is the case with a single end winder. A second drawback is a package defect known as a double-end pickup in which the yarn lines intertangle in the guide slot, breaking one yarn line which then causes both yarn lines to wind to a single package instead of separating with one yarn line per package.

SUMMARY OF THE INVENTION

In order to avoid these drawbacks, a traversing guide system that is self-stringing and is capable of handling two or more ends of yarn has been devised for a yarn windup that includes a yarn source, a fixed guide through which yarn advances in a plane from the source to a traverse guide from which it advances as it is being wound in a reciprocation stroke onto a package support. The traverse guide comprises a base and a guide plate embedded in and projecting outwardly from the base. The guide plate has an outer end generally parallel to the plane of the yarn and the base and sides which converge to the end from the base. The outer end and one of the converging sides is divided into spaced segments by two guide slots; one of which extends to the outer end of the plate while the other slot extends through a side of the plate. An elongated guide member positioned adjacent the travserse guide and encompassing the length of the traverse stroke has an edge parallel to the plane of the yarn passing to the traverse guide. The edge of the guide member is moveable from a location exposing one of the slots to a location exposing both of the slots of the traverse guide to the yarn passing toward the traverse guide.

DETAILED DESCRIPTION

Figure 1:
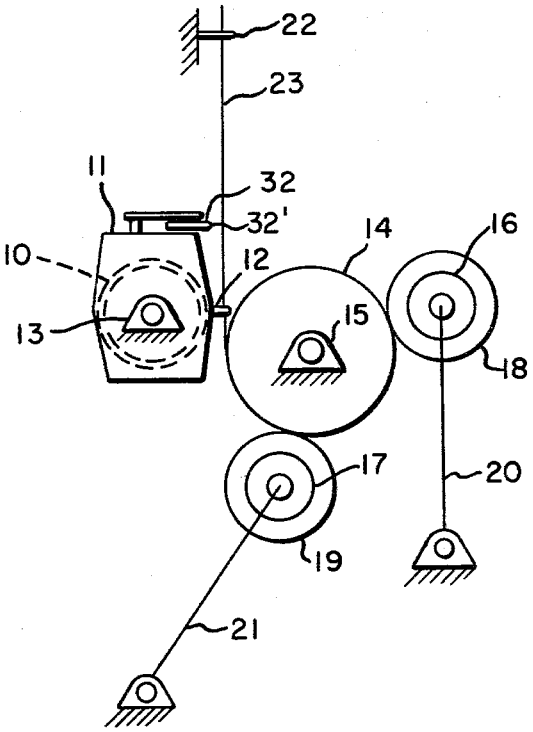
FIG. 1 is a diagrammatic end-elevational view of one type winder to which the present guide is applicable.

The present guide is applicable to a number of winders. FIG. 1 illustrates the one shown for purposes of illustration which generally comprises a barrel cam 10, a cam housing 11, a traverse guide 12, fixed bearings 13 which carry a cam 10, a fixed drive roll 14 in bearings 15, a pair of chucks 16, 17 each carrying bobbins 18, 19 and each mounted on a pivotally mounted swing arm 20, 21. Above the winder is a fixed guide 22 for the yarn 23. Situated near the traverse cam housing 11, is an elongated yarn guide member 32 the outer edge 32' of which is parallel to the plane of traverse of the yarn and which extends for the full width of the traverse.

Figure 4:
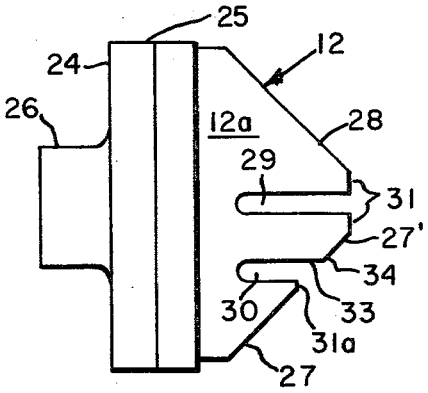
FIG. 4 is an enlarged plan view of the entire traverse guide of the present invention.
Figure 5:
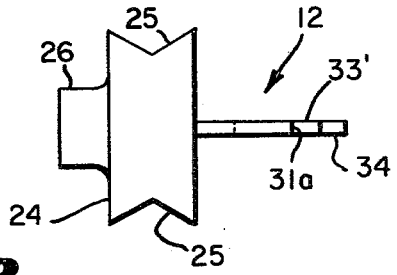
FIG. 5 is an end elevational view of the guide of FIG. 4.

Referring to FIGS. 4 and 5, the traverse guide 12 of the present invention comprises a guide plate 12a embedded in and projecting outwardly from a base 24 comprising a molding (e.g., of Zytel® nylon resin) having a grooved rail-engaging portion 25 and a cylindrical camengaging portion 26 for engaging the generally helical groove of the barrel cam 10. Guide plate **12*a*, a wear-resistant material (e.g., ceramic) is of generally triangular shape having sides 27, 28 that converge toward outer end segment 31 on either side of a pair of generally parallel slots 29, 30. Slot 29 extends through outer segment 31 and slot 30 extends through side 27 of the plate, thus dividing the plate 12 into spaced segments. The bottom ends of the slots 29, 30 are in a common plane which is parallel to the plane of traverse. At the intersection of the left side of the slot 30 and the side 27 is a small flat end segment 31*a* which is generally parallel to the plane of traverse. The flat end segment 31*a*, in effect, cuts away part of one wall of the slot 30 leaving a finite length of the other wall 33 of slot 30** exposed.

Figure 2:
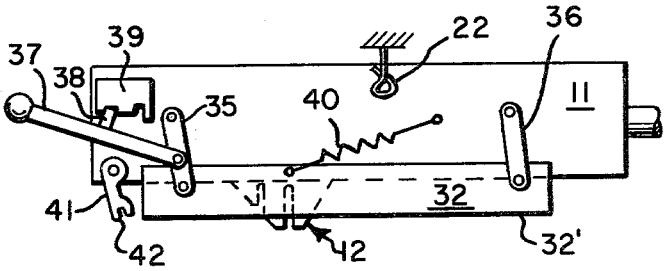
FIG. 2 is a plan view of the principal part of the yarn guide of the present invention shown installed in a barrel cam-driven traverse mechanism; the view includes a straight yarn guide bar which extends across the full width of the traverse near the plane occupied by the traversing yarn.
Figure 3:
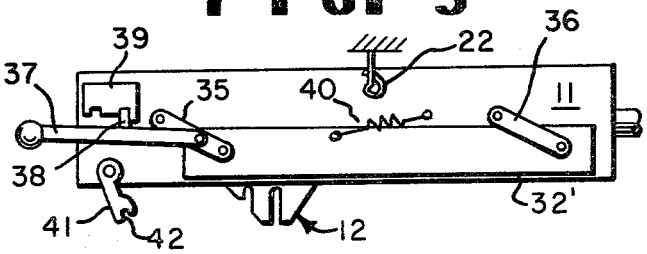
FIG. 3 is a plan view of the same traverse mechanism as FIG. 2 except that the straight yarn guide bar occupies a different position.

Referring now to FIGS. 2 and 3, the elongated guide member 32 is mounted by means of a pair of pivoted links 35, 36 on top of the cam housing 11. One link 35 has a pull bar 37 on the end of the winder accessible to an operator which bar 37 has a pin 38 adapted to occupy either of two positions in a plate 39 fixed to the cam housing thus the outer edge 32' of the bar may be located in either of two positions, an "in" position (FIG. 3), pin 38 in right hand position, in which the edge 32' is slightly in back of the plane of traverse of the yarn 23 and an "out" position (FIG. 2) in which the edge 32' is located such that the yarn is outward relative to line 34 on traverse guide 12 but is not so far "out" as to reach the outer segment 31 of the guide plate **12*a*. The bar 32 is held in the "out" position by latching pin 38 in the left notch manually; it is returned to the "in" position by manually unlatching pin 38 after which spring 40 pulls bar 32** to the right.

Also situated on top of the cam housing 11 is a pivoted yarn guide 41 of the type taught by Pabis, U.S. Pat. No. 3,276,704, which has a yarn guide notch 42 which is located slightly beyond one end of the traverse stroke (i.e., outside the limits of the package to be wound). Prior to winding, this guide 41 in a cocked position, holds a running yarn line in notch 42 outside the limits of a normal traverse stroke when the yarn runs temporarily to a sucker gun (i.e., to waste); the guide also positions the yarn so that it can not yet start winding on an empty bobbin support. On being released from the cocked position, the guide 41 pivots and releases the yarn which quickly becomes snagged in a groove on the bobbin of the type disclosed by Heatherly, U.S. Pat. No. 3,103,305, after which a transfer tail is wound, the traverse guide picks up the yarn and normal winding of a package is started. In operation the guide 41 is manually placed in the cocked position and the guide bar 32 is manually placed and latched in the "out" position. Two running ends of yarn (e.g., from a spinning machine) are picked up by means of a portable air-aspirated sucker gun and are manipulated into guide 22 after which one of the two ends of yarn is placed temporarily in a fixed guide (not shown) positioned so as to prevent that end of yarn from engaging any part of the winder. The other end of yarn is manipulated into notch 42 in guide 41, around drive roll 14, around empty bobbin 19 and thence to a position generally below the winder and somewhat outside the traverse stroke. Next, guide 41 is released from its cocked position to effect the release of the yarn from notch 42 after which the yarn becomes snagged in the groove in the bobbin 19, forms a transfer tail, enters into grazing contact with edge 32' of guide bar 32, moves transversely along edge 32', and, subsequently, is caught up in notch 29 of moving traverse guide 12. This latter occurs because the edge 32' holds this first running end of yarn outside line 34 on guide 12 in a position to be cammed by the sloping edge 27' outward and into slot 29. This starts normal winding and package formation on bobbin 19. Next, the operator releases the guide 32 to the "in" position, re-cocks the pivoted guide 41, removes the second end of yarn from its temporary guide, manipulates it into notch 42, around the drive roll 14 up to and around the empty bobbin 18, then releases guide 41; this has substantially the same effect as before except that now the yarn engages edge 27 of guide 12 and is cammed outwardly but encounters flat 31a, then right wall 33 just outside slot 30 after which the yarn can "climb" no farther "out" on sloping edge 27 but is caught up in slot 30. Subsequently, normal winding begins on the bobbin 18. Now, normal winding proceeds with each end of yarn in its respective slots 29, 30.

Figure 6:
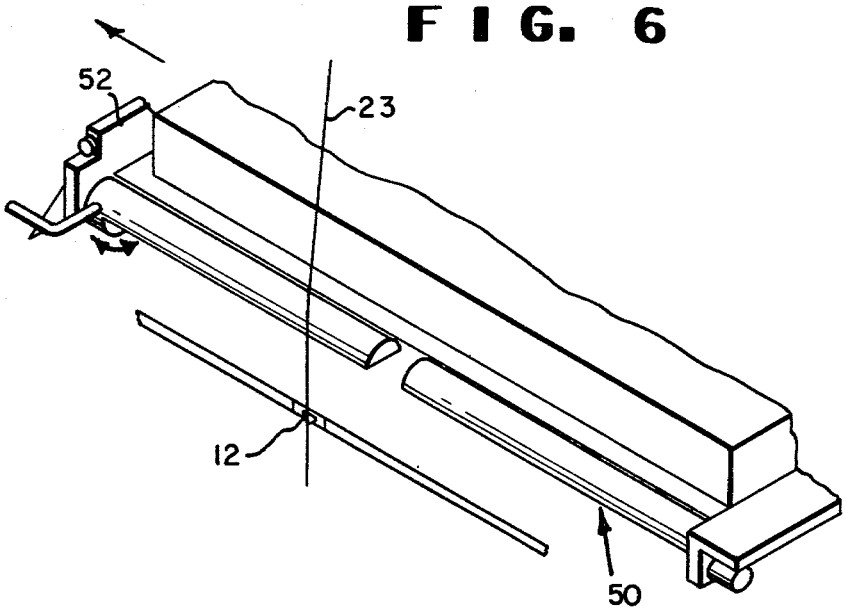
FIG. 6 is a perspective of an alternate arrangement for the guide member of this invention.
Figure 7:
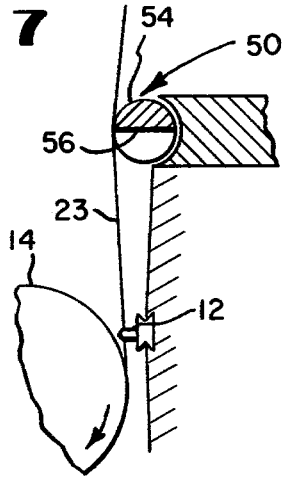
FIG. 7 is a sectioned view of FIG. 6 taken along the line 6—6.

In an alternate embodiment shown in FIGS. 6 and 7 elongated member 50 rotatably mounted in frame 52 adjacent the traverse guide 12 serves the same function as elongated guide member 32. However, in this embodiment the surfaces 54, 56, form an eccentric cam surface and depending on their position opposite the yarn 23, determine whether only slot 29 is exposed or whether both slots 29 and 30 are exposed to the yarn 23. In the position shown, the surface 54 contacts the yarn so that a first running end of yarn would be cammed by sloping edge 27' of guide plate 12 into slot 29. The member 50 is then rotated so that the surface 56 exposes slot 30 to the second running end of yarn which is then caught in slot 30 and normal winding proceeds with one end of yarn in each slot.

I claim:

1. A windup including a source of at least two yarns, a fixed guide through which said yarns advance in a plane from said source to a traverse guide from which the yarns advance as they are being wound in a reciprocating stroke on respective package supports, said traverse guide comprising: a base, a guide plate embedded in and projecting outwardly from the base, said plate having an outer end generally parallel to said plane and said base and sides converging thereto from the base, said outer end and one of said converging sides being divided into spaced segments by two guide slots, one of said slots extending to said outer end, the other slot extending through a side of said plate and an elongated guide member positioned adjacent said traverse guide, said guide member having an edge parallel to said plane and extending the length of said stroke, the edge of said guide member being movable from one location exposing one of said slots to another location exposing both of said slots to said yarns, whereby one of said yarns is directed to one of said slots when the guide member is at said one location and the other of said yarns is directed to the other of said slots when the guide member is at the other location.

2. The windup of claim 1 wherein said elongated guide member is a flat rectangular shaped bar connected to said windup by a linkage for movement of an elongated edge toward and away from said outer end of said guide.

3. The windup of claim 1, wherein said elongated guide member is a rod having an eccentrically shaped cam surface, said rod being rotatable with respect to said yarns, said cam surface contacting said yarns, one portion of said cam surface exposing both slots to said yarns, another portion of said cam surface exposing one slot to said yarns.

* * * * *